United States Patent [19]

Ayers

[11] Patent Number: 4,556,341

[45] Date of Patent: Dec. 3, 1985

[54] WORK PLATFORM

[75] Inventor: Ray R. Ayers, Houston, Tex.

[73] Assignee: Shell Oil Company, Houston, Tex.

[21] Appl. No.: 701,816

[22] Filed: Feb. 19, 1985

Related U.S. Application Data

[63] Continuation of Ser. No. 443,095, Nov. 19, 1982.

[51] Int. Cl.[4] ..... E02D 21/00

[52] U.S. Cl. ..... 405/195; 114/264; 114/258; 169/69; 212/190; 405/166

[58] Field of Search ..... 405/195–208, 405/219, 220, 221; 212/190–194; 114/265; 169/69

[56] References Cited

U.S. PATENT DOCUMENTS

| | | | |
|---|---|---|---|
| 623,267 | 4/1899 | Walsh | 212/190 |
| 2,118,909 | 5/1938 | Weichardt et al. | 114/261 |
| 2,421,377 | 6/1947 | Gross | 114/264 X |
| 2,761,409 | 9/1956 | Harris | 405/219 X |
| 2,931,184 | 4/1960 | D'Arcangelo | 405/224 |
| 2,934,905 | 5/1960 | Woolslayer et al. | 114/264 X |
| 3,009,326 | 11/1961 | Williams | 405/220 X |
| 3,685,584 | 8/1972 | Gracia | 169/69 X |
| 3,704,596 | 12/1972 | Lloyd | 114/265 X |
| 3,724,555 | 4/1973 | Chiasson et al. | 169/69 X |
| 3,765,463 | 10/1973 | Gassett et al. | 114/264 X |
| 4,006,082 | 2/1977 | Irons | 405/63 X |
| 4,037,420 | 7/1977 | Wicks | 405/227 X |
| 4,156,577 | 5/1979 | McMakin | 114/265 X |
| 4,372,395 | 2/1983 | Hammett | 169/69 |
| 4,442,943 | 4/1984 | Triplett | 212/190 X |

FOREIGN PATENT DOCUMENTS

| | | | |
|---|---|---|---|
| 61898 | 10/1913 | Austria | 212/190 |
| 336224 | 4/1921 | Fed. Rep. of Germany | 212/190 |
| 341044 | 9/1921 | Fed. Rep. of Germany | 212/190 |
| 778308 | 12/1934 | France | 212/190 |
| 250876 | 11/1926 | Italy | 212/190 |
| 546558 | 3/1977 | U.S.S.R. | 114/264 |

*Primary Examiner*—Dennis L. Taylor

[57] ABSTRACT

A stable offshore platform for surface or undersea work is provided by connecting a semisubmersible trailer unit with a workboat. Preferably, two columns of the trailer are joined by a beam member or truss, and this assembly is linked to the workboat via a truss-like trailer tongue with a ball swivel joint. When in transit, the semisubmersible unit is deballasted to a shallow draft condition and towed by the workboat.

6 Claims, 17 Drawing Figures

FIG. 5 DIVING AND MARINE SUPPORT
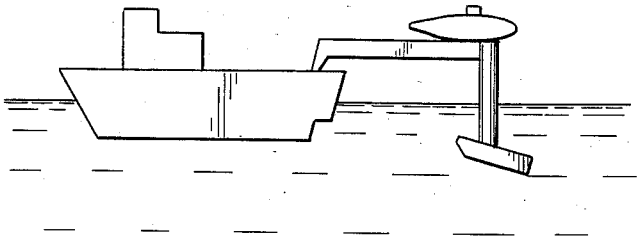
FIG. 6
SUBSEA WELL SERVICE OR CORE DRILLING
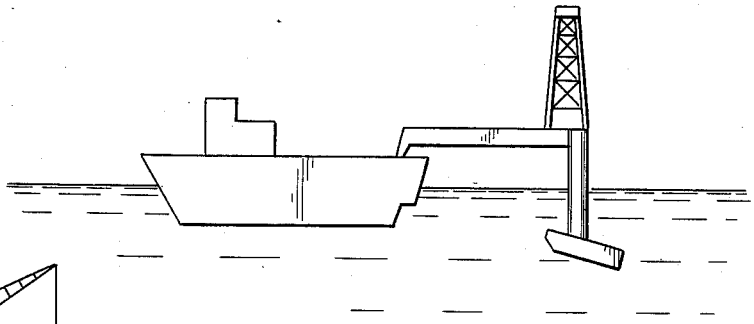
FIG. 7
PLATFORM TENDER
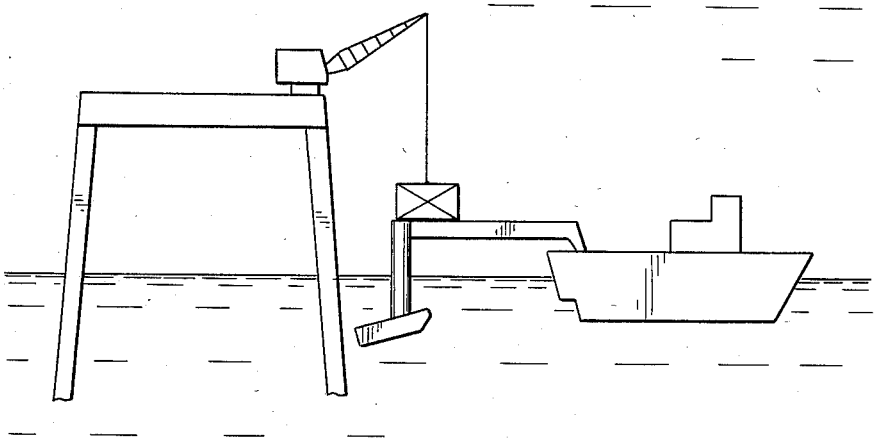
FIG. 8 LOADING
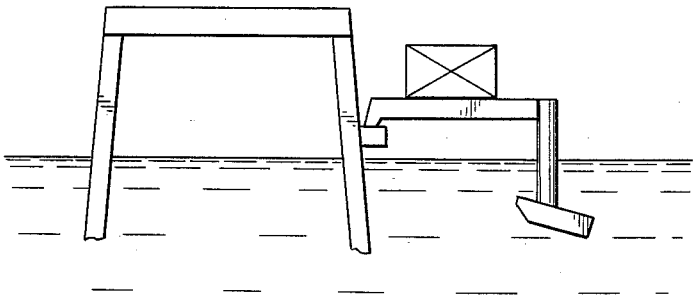
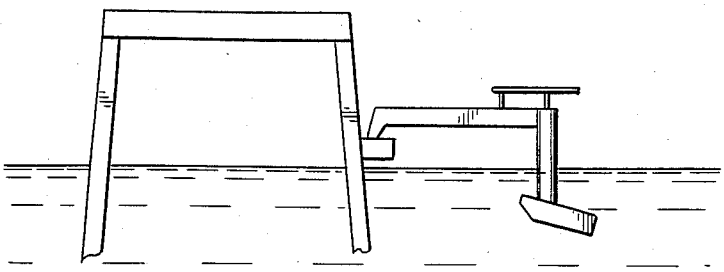
FIG. 9
HELIPORT FIG.10 FIRE FIGHTING SERVICE
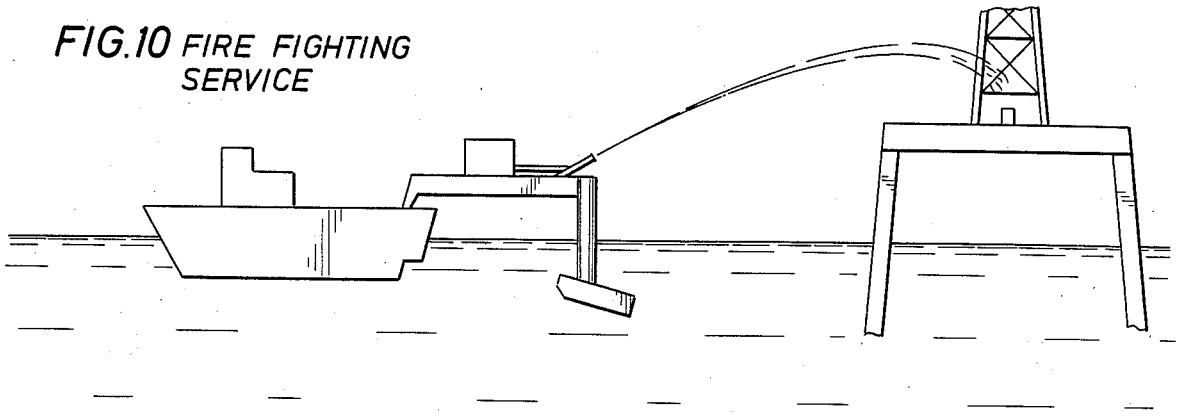
FIG.11 SEISMIC WORK
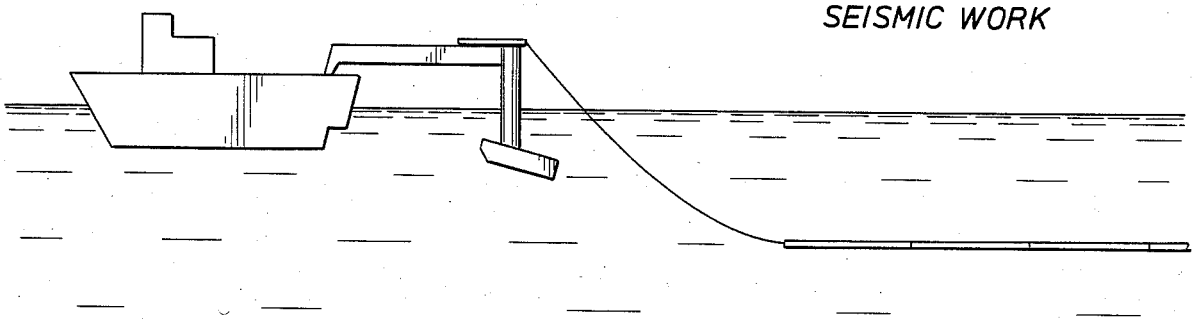
FIG.12 SALVAGE SUPPORT
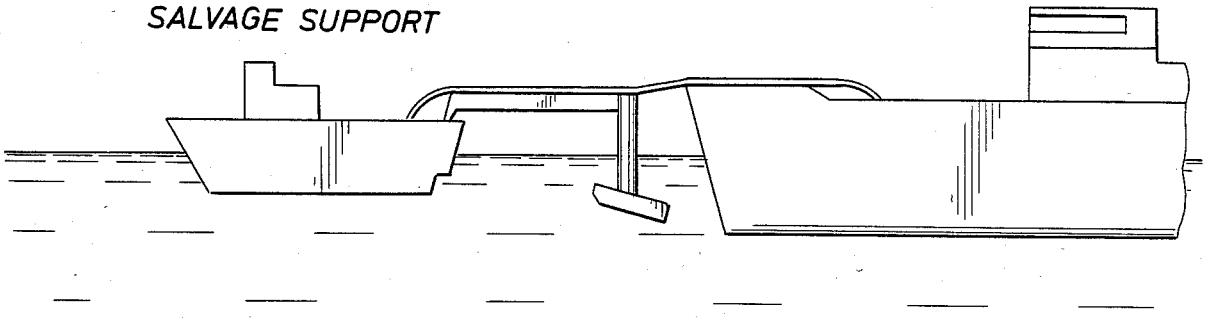
FIG.13 SPILLED OIL RECOVERY
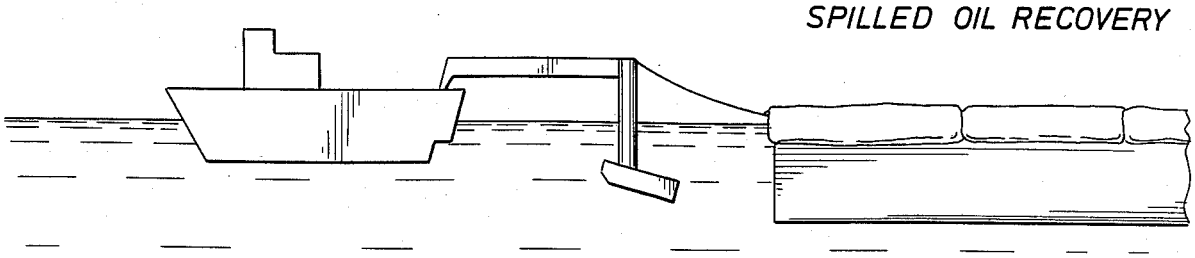

FIG.14 INSTALLATION, REMOVAL AND MAINTENANCE OF BUOYS
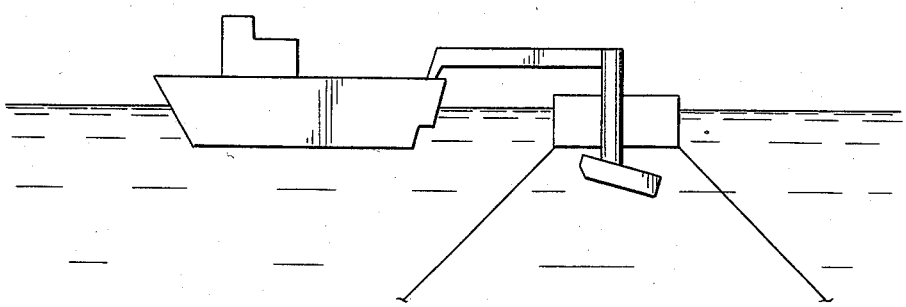
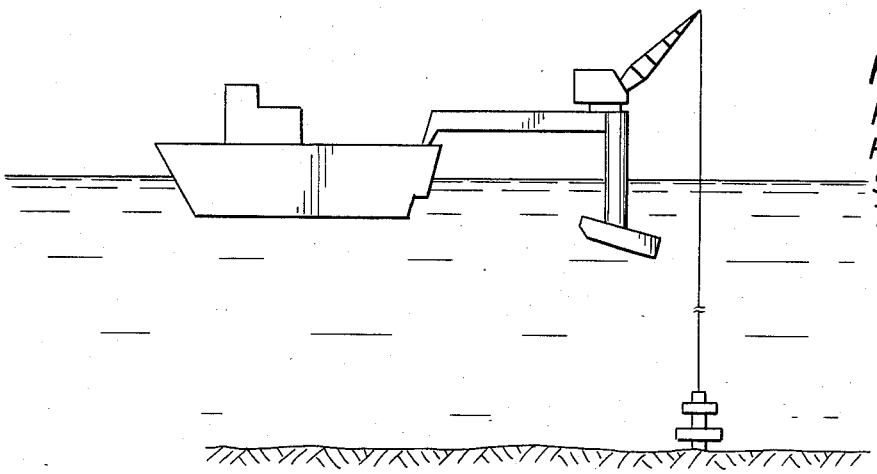
FIG.15 PLACEMENT AND REMOVAL OF STRUCTURES ON THE SEAFLOOR
FIG.16 ANCHOR HANDLING FOR PIPELAY OR OTHER VESSELS
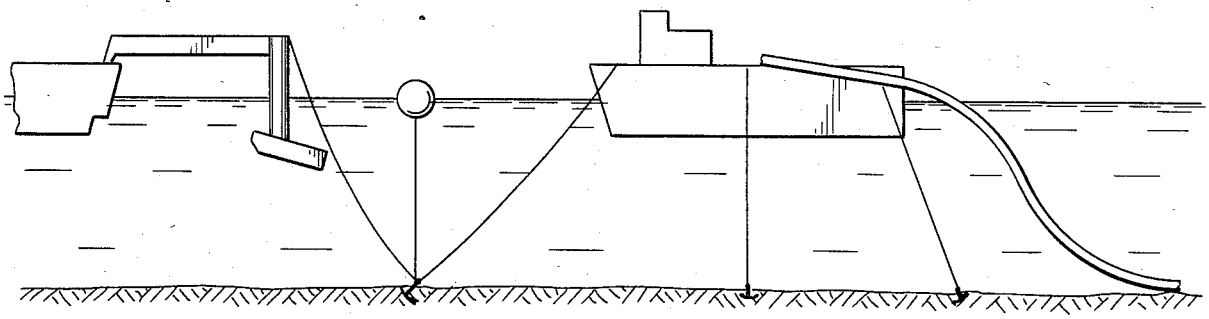
FIG.17 PIPELAY STINGER SUPPORT
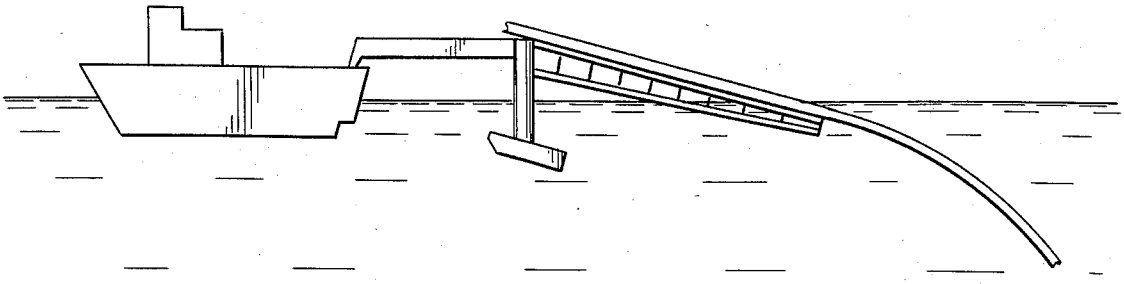

WORK PLATFORM

REFERENCE TO RELATED APPLICATIONS

This is a continuation of application Ser. No. 443,095 filed Nov. 19, 1982.

BACKGROUND OF THE INVENTION

Many thousands of vessels form a fleet of marine transportation boats serving companies working in offshore waters throughout the world. The vast majority of these vessels support offshore oil and gas exploration and production activities. Most of these vessels are classed as tugboats, supply boats, or crew boats, and have displacement type hulls. A common problem with such hulls is that it is difficult for men to perform useful work from the decks thereof due to waves which wet the decks and which cause excessive roll and pitch motions of the vessels. Weather in the Gulf of Mexico is occasionally severe enough to hinder or delay operations, but weather in the North Sea is so severe as to have a significant impact on operations from such vessels. Transfer of men and equipment to offshore platforms, handling of anchor buoys, and deployment of men and equipment subsea are examples of operations wherein a safe and stable work platform is needed.

A potential solution to this problem is to build and use larger vessels. This slightly improves the situation, but at a significantly increased cost, and generally it is not considered an economically feasible approach.

Another potential solution is to build a fleet of small to medium sized, column-stabilized, semisubmersible vessels like the larger semisubmersible vessels used for drilling operations. These are stable work platforms having long natural periods of response in the order of 20 to 40 seconds. By contrast, a 200-foot supply boat has natural periods of from 6 to 9 seconds, which is quite close to the period range of highest wave energy. While such semisubmersibles would significantly reduce wave-induced motions and deck wetness, it would be an excessive cost of retiring the conventional fleet and building a new and more expensive fleet.

SUMMARY OF THE INVENTION

The present invention generally pertains to a work platform and methods for the use thereof, which platform includes at least two connected semisubmersible flotation means, means for pivoting the flotation means, and connecting means extending between the flotation means and the pivoting means. In a preferred embodiment, the flotation means is two connected pontoons, and the pivoting means is a ball swivel joint.

More generally, the present invention pertains to a stable offshore platform and methods for the use thereof for surface or subsea work, which platform is a semisubmersible unit attachable to a workboat or other support means. In a preferred embodiment, pontoons of the semisubmersible unit are connected to the workboat or other support means via a gooseneck truss, trailer tongue or the like, and a ball swivel joint or the equivalent. When not in use, or in transit, the semi-submersible unit may be deballasted to ride high in the water and permit entrance to shallow harbors, or it may be hoisted over the workboat or other vessel or support means.

A preferred method for using the work platform involves positioning the platform over at least one object in the water, and securing and raising the object to the platform. The object may be, for example, a buoy which is to be repaired or refurbished, or a spring buoy used to position an articulated drilling platform, or the object may be an anchor of a pipelay vessel which is to be moved to a different position. Another preferred method for using the work platform requires using the platform to support underwater operations. The underwater operations may be, for example, diving operations, submarine deployment and retrieval, subsea well service, and core drilling and bottom sampling. Yet another preferred method pertains to utilizing the work platform as a stable base from which associated operations requiring stability are directed. Stability is required, for example, wherein fire fighting equipment is deployed on the work platform or wherein helicopters are landed on the work platform. And another preferred method involves utilizing the work platform as a stable pulling means. For example, seismic cables or oil skimmers may be pulled with the platform.

BRIEF DESCRIPTION OF THE DRAWINGS

FIGS. 5–17 exemplify various uses of the apparatus.

PREFERRED EMBODIMENT OF THE INVENTION

The present invention provides a new solution to problems of offshore handling and transfer operations in rough weather (see related U.S. patent application Ser. No. 197,399 filed Oct. 16, 1980). Generally, the invention is a semisubmersible, gooseneck style trailer work platform which is towable by a conventional vessel such as a supply boat, or by other means. The trailer/work platform is pivotable from a raised or hoisted transit mode to a lowered or partially submerged working mode. With the floating semisubmersible trailer/work platform, workmen can safely climb aboard from a supply boat, rig, or other vessel and do useful work on a stable, dry deck. Further, using the present invention, men and equipment can be easily and safely transferred subsea or upward to an offshore platform or larger floating vessel.

Figure 1:
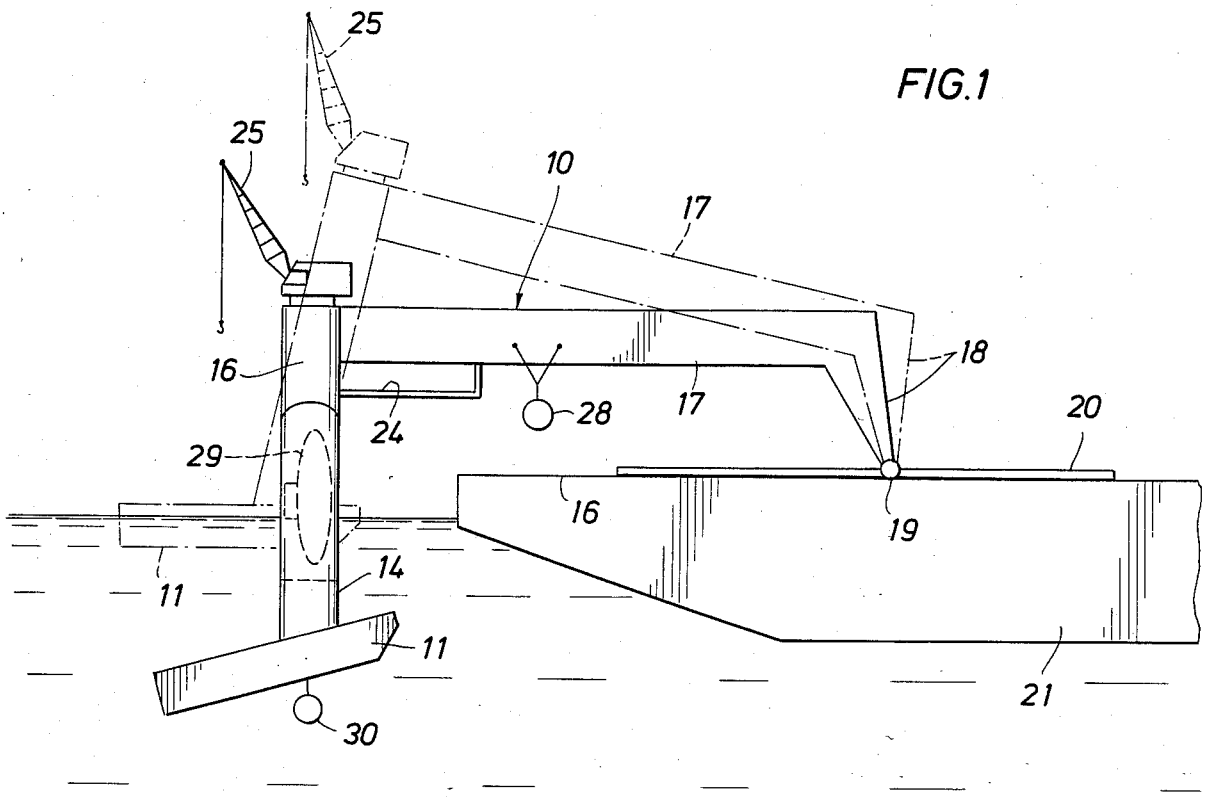
FIG. 1 discloses a side view of the apparatus of the present invention.
Figure 2:
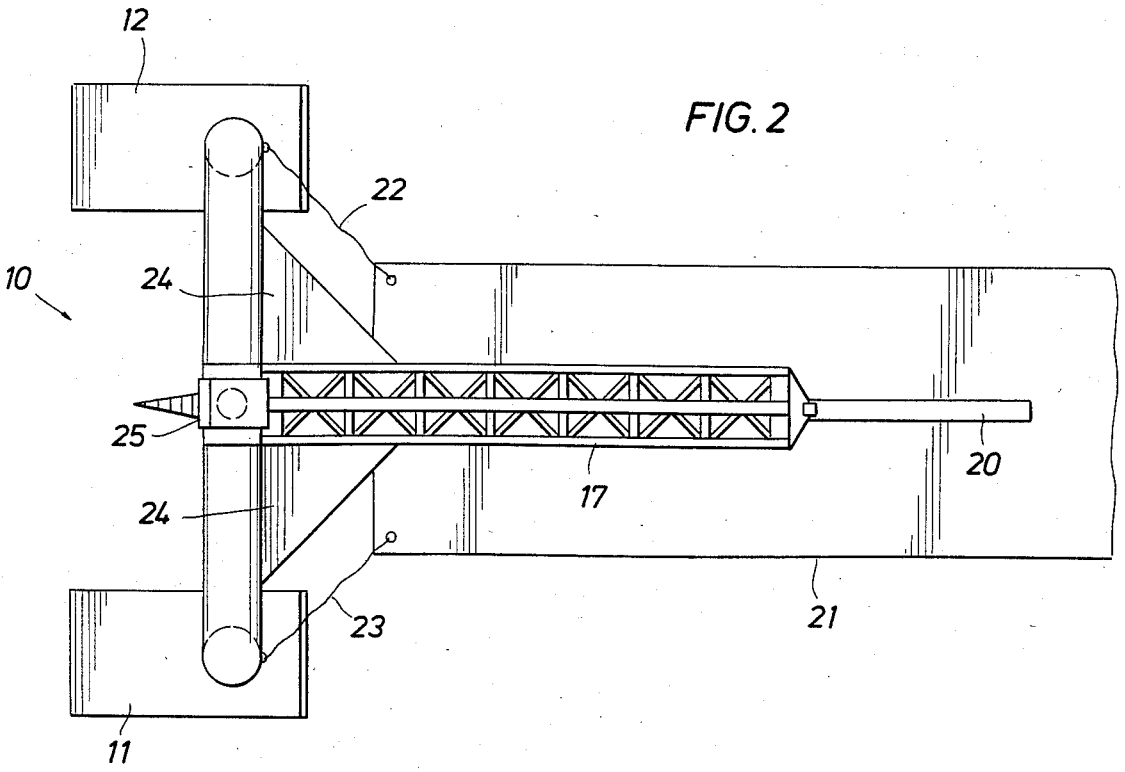
FIG. 2 provides a plan view.
Figure 3:
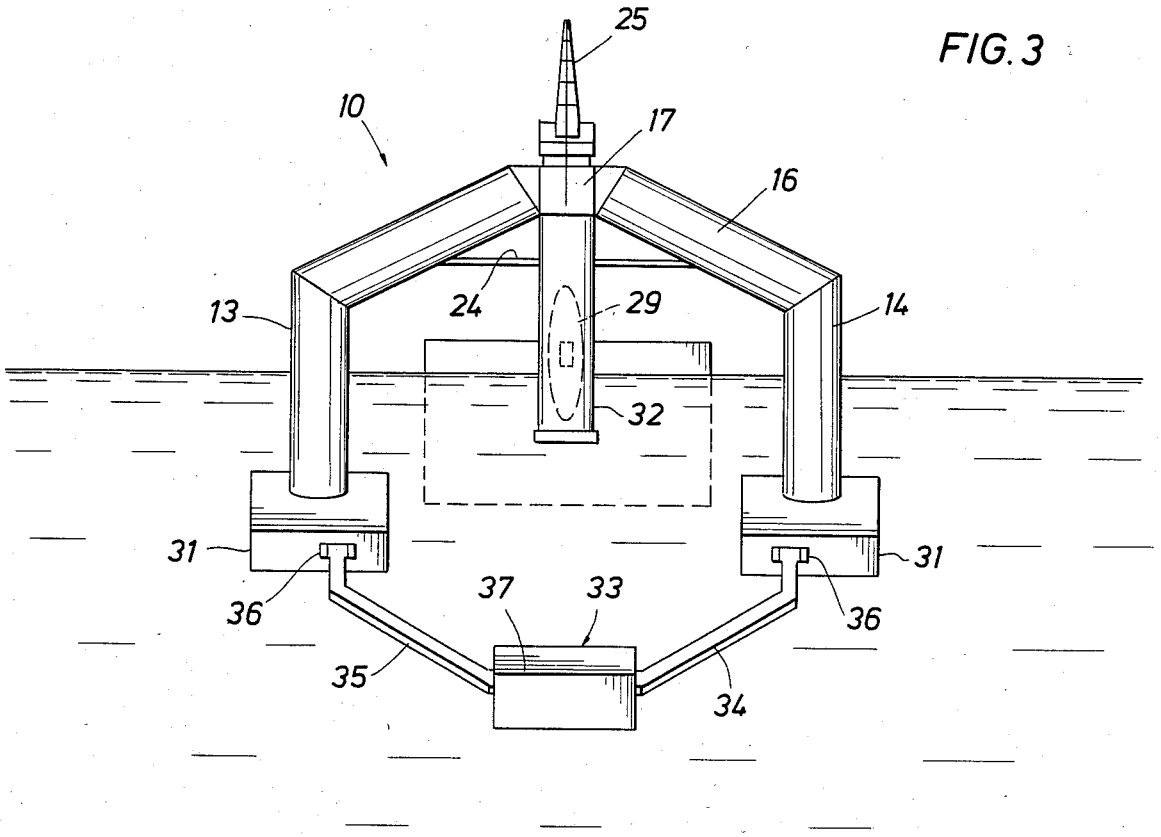
FIG. 3 provides a view from astern.

As shown in FIG. 1, the semisubmersible trailer/work platform 10 includes pontoons 11 and 12 which may be in a lowered position for work use or in a partially raised position (as shown in phantom) for transit. Alternatively, the pontoons may be hoisted over the vessel or other support means. Pontoons 11 and 12 are at the ends of two vertical columns 13 and 14 which in turn are connected by slanted cross beams 15 and 16 which abut pivoting framework 17. Vertical beam 18 extends downwardly from the opposite end of framework 17 to a ball swivel joint 19, or the like, which in turn can be mounted on a track or slot 20 so that it can be moved forward or aft, or even released aft in an emergency. If the trailer/work platform is released, buoyancy 9 in beam 18 provides sufficient flotation to prevent the trailer/work platform from overturning. The buoyancy 9 may be a water tight compartment, tankage, foam, etc.

For best motion response with platform 10 in a working mode, ball swivel joint 19 is located at the center of pitch of the supply vessel or other support means 21 to which it is attached. For storm survival, ball swivel joint 19 can be moved aft to minimize the risk of the underside of the pivoting means or framework 17 contacting the stern of vessel 21 while the vessel is pitching in severe waves. Alternatively, or in addition, the trailer/work platform 10 can be deballasted to a light condition as shown in phantom in FIG. 1 for storm survival. Low tension tieback ropes, chains or cables 22 and 23 are used to ensure that the trailer/work platform does not jackknife into contact with the vessel or other support means.

The trailer/work platform 10 can take many forms, depending on the specific application. Thus, it can have an aft deck 24 to support workmen or it can be used for offloading to platforms. Crane 25 may be used for offloading to platforms, etc. not having cranes, but it generally is preferred to use other cranes when available. The trailer/work platform can have various other lifting means such as gantry hoist 28 for lifting loads from supply vessel deck 26 to work platform 24 or to move equipment and/or personnel subsea. Also, the trailer/work platform can support submarine operations 29 by having special launch/recovery equipment. Although submarines can be launched from the platform in various ways, it is preferred to launch from a duct 32 between pontoons 11 and 12. This facilitates getting the submarine through the wave/air interface, hence the cylindrical duct 32 to guide the submarine in and out of the water. Alternatively, an elevator may be used to lift and lower the submarine. Although it is prudent to keep the trailer/work platform simple, thrusters 30 can be placed in pontoons 11 and 12 and extended downward for operation to aid in offloading operations, then retracted when not in use.

Just like other semisubmersibles, the trailer/work platform 10 can be towed out in a shallow draft, low ballast condition and then be ballasted down at the work site to perform required work. By towing the trailer/work platform in a lightened condition, the reduction in tow vessel speed due to the trailer is normally small, and shallow harbors can be used. In the lightened mode, the trailer/work platform 10 has the performance of a displacement type catamaran. Once the trailer/work platform is ballasted down with equipment weight and/or by water 31, the favorable long period semisubmersible characteristics above mentioned appear.

Figure 4:
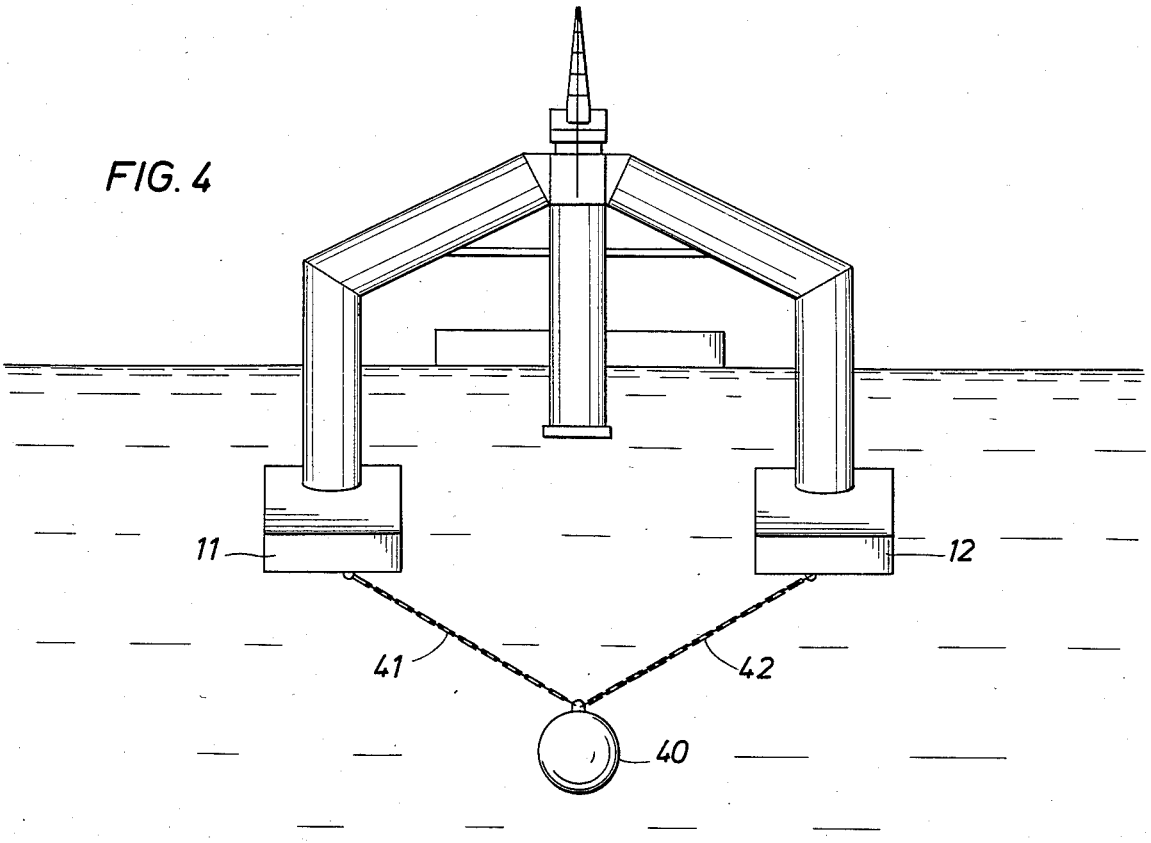
FIG. 4 discloses a modification of the embodiment of FIG. 3.

A floodable chamber 33 may be attached to pontoons 11 and 12 be beams 34 and 35 and hinges 36 in order to provide added stability to the semisubmersible. The amount of ballast in chamber 33 is adjustable by changing water level 37. This chamber provides more righting moment in roll of the semisubmersible. Alternatively, a dead weight 40 may be suspended by cables 41 and 42 from pontoons 11 and 12 as shown in FIG. 4.

PRINCIPAL CHARACTERISTICS OF THE TRAILER/WORK PLATFORM

Characteristics of the trailer/work platform can generally be divided into two categories:

Direct Load Lifting-in which the trailer/work platform serves as a "sea crane" to handle lifts or lowerings of structures between its support pontoons. Hence, such lifts are called direct lifts (at full capacity), as contrasted with lifts by ordinary cranes which must be accomplished "over the side", with a derated crane lift capacity.

Stable Work Platform-in which the trailer/work platform principally serves as a stable floating structure upon which, and from which, useful work can be safely and effectively performed without wave-induced problems. Thus, in use a stable work platform is provided to do above water work as well as support subsea work.

It should be recognized that any offshore operation involves the use of both of the above two principal characteristics of the trailer/work platform, i.e. a stable work platform and a sea crane, so it is often difficult to determine which characteristic is predominant. However, the following examples generally require more of the stable work platform characteristic:

(1) Diving and Submarine support-The trailer/work platform can be fully outfitted with equipment known to the art to provide support for diving (e.g., diving bell) and submarine operations (FIG. 5). The conventional way of supporting a submarine is to put a large A-frame with a davit on the stern of a supply boat. Sea states of 4–6 feet are the limit of supply boats, while the trailer/work platform can handle 12–16 feet seas, or higher.

(2) Subsea Well Service or Core Drilling-The trailer/work platform is ideally suited to core drilling, i.e., getting a sample of bottom soil (FIG. 6). To perform this task, a small derrick is mounted on the platform and drilling operations performed therefrom. The derrick can also be used for maintaining or servicing subsea wells.

(3) Platform Tender-The trailer/work platform can be loaded with providions to be brought offshore to a well platform location by a supply boat (FIG. 7). A winch or other means on the well platform to the well platform. Then the supply boat is free to perform other functions and the trailer/work platform can be unloaded as needed without interruption of drilling operations on the well platform.

(4) Loading-This use also pertains to delivering equipment, etc., to an offshore platform or vessel (FIG. 8). In rough seas it is desirable to remove equipment by crane from the stable trailer/work platform rather than from a wave-tossed supply vessel. The trailer/work platform can be backed up to the platform under an overhead crane. For this purpose, propulsion may be provided in the legs of the trailer/work platform.

(5) Heliport-A trailer/work platform may be employed as a heliport in areas which otherwise don't have a landing pad for helicopters (FIG. 9).

(6) Firefighting Service-Firefighting equipment, e.g., pumps, nozzles, etc., can be monted on the trailer/work platform, which then can be backed up to a vessel on fire or an oil well fire, etc., and provide a high platform so that water may be directed accurately down onto the fire, as opposed to the conventional method of arcing the water upward and then downward onto the fire (FIG. 10). The pumps can also be used as propulsion means for the trailer/work platform.

(7) Seismic Work-The trailer/work platform also is adaptable to towing seismic source guns and streamer cables (FIG. 11). With typical seismic operations underway, rough weather can cause problems; hence the motion at the stern of the vessel where the seismic cable is towed causes changes in tension in the cable, thus interfering with seismic recovery. By comparison, the trailer/work platform is very stable in rough weather, which makes it excellent for handling seismic equipment.

(8) Salvage Support-The trailer/work platform is particularly suitable to removing people and cargo from a stricken vessel in a safe manner (FIG. 12). Thus, the platform can be backed up to the stricken vessel, thereby keeping a safe distance between the stricken vessel and the rescue/tow vessel. Dangerous cargo, e.g. oil, can be lightered from the stricken vessel by hoses passing across the platform to a receiving vessel. The trailer/work platform also eliminates the necessity for small boats working adjacent the stricken vessel to handle divers, workmen, etc.

(9) Spilled Oil Recovery-The trailer/work platform, due to its stability in rough weather, is especially useful for recovering spilled oil (FIG. 13). Accordingly, the platform can be used independently, with its own propulsion system to tow oil skimmers, etc., once the platform has been towed to the oil spill scene by a workboat, etc. A barge may be used in conjunction with the trailer/work platform to store recovered oil.

In the examples which follow, involving typical offshore operations, the above two mentioned characteristics also are embodied; however, the sea crane characteristic is predominant:

(1) Installation, Removal and Maintenance of Buoys-Buoys are used, for example, in harbors to mark channels or provide warning (FIG. 14) or as part of a loading terminal such as a single point mooring buoy. Such buoys are in a wave environment for long periods of time and frequent maintenance is required. Such maintenance and refurbishing is a difficult task because of the difficulty of effecting repairs in situ. Each buoy must be removed from its moorings, brought to shore, repaired, etc., then brought back to sea. However, the trailer/work platform can be positioned above the buoy as a floating crane to lift the buoy up and snug the buoy against the stable bottom side of the platform, whereby on-site maintenance work can be performed on the buoy without further moving it.

(2) Placement and Removal of Structures on the Seafloor-Here the principal operation is to both deliver and place a structure such as a subsea well template at a subsea location without use of a separate derrick vessel for placement (FIG. 15). Alternatively, structures (such as anchors, well templates, downed airplanes, BOP stacks, small boats, etc.) can be recovered from a subsea location by use of the direct lift capability. Cyclic wave-induced loads are minimized due to the inherent stability of the trailer/work platform.

(3) Anchor Handling for Pipelay or Other Vessels-One leveling factor for laying pipelines in rough water is that of moving anchors head. Although the pipelay vessel can handle the waves, conventional anchor handling tugs often cannot. Use of the trailer/work platform to capture the buoy and move up the anchor makes this operation significantly easier (FIG. 16).

(4) Pipelay Stinger Support-The trailer/work platform can be combined with a pipeline stinger to provide a stronger, easier to deploy, more repairable and more transportable stinger than is possible with conventional stingers (FIG. 17).

EXAMPLES

The present invention was tested at 1/50th scale in a wave tank, using a simulated 2000-ton prototype supply vessel and a simulated 350-ton trailer/work platform, the trailer/work platform was calm and stable in 12 and 25-foot waves with wave lengths 20 times the wave height while the bow moored vessel was excessively pitching and rolling. Natural periods for prototype roll and heave for the trailer/work platform were in the 15 to 35 second range. For this combination of trailer/work platform and vessel, useful work could be done in wave heights to about 20 feet. The vessel/trailer/work platform combination tracked well under tow in both light and heavy ballast conditions. Based on estimations, light ballast condition would only reduce the normal vessel transit speed by no more than one knot.

PRIOR ART

U.S. Pat. No. 3,323,478 discloses a method of joining two vessels of conventional shape using spreader bars and tie lines, with a truss work between the vessels supporting a drilling rig. The joined vessels are like a hinged catamaran and not like a semisubmersible vessel as used with the present invention and as shown in *The Technology of Offshore Drilling, Completion and Production* by ETA Offshore Seminars, Inc., 1976, page 14. In the present invention the trailer is at the stern of the towing vessel, as opposed to alongside the vessel. Also, the present invention is structurally joined to the towing vessel with a single ball swivel joint and not the complicated means shown in U.S. Pat. No. 3,323,478.

*The Technology of Offshore Drilling* (above cited, page 14) shows a typical semisubmersible vessel commonly seen in rough weather areas like the North Sea as well as in more moderate weather climates. These vessels are free standing, either self-propelled and positioned with thrusters or non-self-propelled and moored in position to do work. If the semisubmersible is not self-propelled, it is towed to its work location by tow vessels using tow lines between the tow vessels and the semisubmersible vessel. Thus, the semisubmersible is handled like a conventional barge. By comparison with a free standing semisubmersible, the semisubmersible of the present invention has one corner supported by a structural ball swivel joint on the deck of a tow vessel. So, in effect, the semisubmersible of the present invention is like a trailer at the rear of the tow vessel and is markedly dissimilar to a free standing semisubmersible.

*Manned Submersibles* by R. Frank Busby, 1976, page 611, Office of the Oceanographer of the U.S. Navy, shows how a spar buoy assembly can be connected alongside a floating vessel by way of a single-degree-of-freedom hinge (like a door hinge). This assembly then can be used to support operations of a subsea nature. By comparison with the present invention, (a) the spar buoy assembly is positioned alongside the vessel and not behind it; (b) the spar buoy assembly has no submerged pontoon below water to permit heavier lifts, (c) the hinge point of the spar buoy assembly is well above the vessel deck so that roll motion of the vessel is amplified into a sizable transverse motion and rotation of the spar buoy assembly, (d) the hinge of the spar buoy assembly is a simple one-degree-of-freedom hinge and not a ball swivel hinge having three degrees of freedom as in the present invention and (e) there is only one flotation means (a spar buoy) whereas a minimum of two flotation means (columns plus pontoons) is utilized by the present invention. Hence, there are few similarities between the present invention and the spar buoy assembly.

What is claimed is:

1. A method for providing a floating offshore heliport comprising:

providing a semisubmersible platform having flotation means beneath one side and pivotally attachable connection means on the opposite side, the platform being located substantially above the reach of wave action and being supported by columns extending downwardly to the flotation means which is located substantially beneath the influence of the wave action, whereby the platform does not substantially react to the wave action; and attaching the platform to the offshore structure via the connection means.

2. A method for fighting an offshore fire comprising:

providing a semisubmersible platform having flotation means beneath one side and connection means on the opposite side which is pivotally attached to a tow vessel, the platform being located substantially above the reach of wave action and being supported by columns extending downwardly to the flotation means which is located substantially beneath the influence of the wave action, whereby the platform does not substantially react to the wave action;

providing firefighting means on the platform; and maneuvering the platform with the vessel to place the platform relatively close to a fire while keeping the tow vessel further and more safely away from the fire.

3. The method of claim 2 wherein the platform is substantially higher than the vessel, and water from the platform is directed downwardly upon the fire.

4. A method for towing a seismic source gun and streamer cable, comprising:

providing a semisubmersible platform having flotation means beneath one side and connection means on the opposite side pivotally attached to a tow vessel, the platform being located substantially above the reach of wave action and being supported by columns extending downwardly to the flotation means which is located substantially beneath the influence of the wave action, whereby the platform does not substantially react to the wave action; and towing the platform with the tow vessel and towing the seismic source gun and streamer cable with the platform.

5. A method for removing cargo and/or people from a stricken vessel, comprising:

providing a semisubmersible platform having flotation means beneath one side and connection means on the opposite side pivotally attached to a tow vessel, the platform being located substantially above the reach of wave action and being supported by columns extending downwardly to the flotation means which is located substantially beneath the influence of the wave action, whereby the platform does not substantially react to the wave action;

providing means on the platform for removal of cargo and/or people from the stricken vessel; and manuevering the platform with the vessel to place the platform relatively close to the stricken vessel while keeping the tow vessel further and more safely away from the stricken vessel.

6. A method for recovering oil spilled on water, comprising:

providing a semisubmersible platform having flotation means beneath one side and connection means on the opposite side pivotally attached to a tow vessel, the platform being located substantially above the reach of wave action and being supported by columns extending downwardly to the flotation means which is located substantially beneath the influence of the wave action, whereby the platform does not substantially react to the wave action; and towing the platform with the tow vessel and towing oil collection means with the platform.

* * * * *